United States Patent [19]

Iwama

[11] Patent Number: 4,908,965

[45] Date of Patent: Mar. 20, 1990

[54] SKI BOOT FASTENING DEVICE

[75] Inventor: Shinichi Iwama, Tokyo, Japan

[73] Assignee: Daiwa Seiko, Inc., Tokyo, Japan

[21] Appl. No.: 249,650

[22] Filed: Sep. 27, 1988

[30] Foreign Application Priority Data

Oct. 9, 1987 [JP] Japan ..... 62-155406[U]
Aug. 24, 1988 [JP] Japan ..... 63-110731[U]

[51] Int. Cl.[4] ..... A43B 5/04; A43C 11/00

[52] U.S. Cl. ..... 36/119; 36/50; 36/121

[58] Field of Search ..... 36/117–121, 36/50; 24/68 SK

[56] References Cited

U.S. PATENT DOCUMENTS

| | | | |
|---|---|---|---|
| 4,677,768 | 7/1987 | Benoit et al. | 36/117 |
| 4,698,920 | 10/1987 | Benoit et al. | 36/117 |
| 4,706,393 | 11/1987 | Marxer | 36/117 |
| 4,711,042 | 12/1987 | Morell et al. | 36/50 |
| 4,757,621 | 7/1988 | Iwama | 36/119 |
| 4,759,137 | 7/1988 | Lederer | 36/50 |

FOREIGN PATENT DOCUMENTS

| | | |
|---|---|---|
| 60-225502 | 11/1985 | Japan . |
| 61-109502 | 5/1986 | Japan . |
| 62-64301 | 3/1987 | Japan . |

*Primary Examiner*—James Kee Chi
*Attorney, Agent, or Firm*—Kalish & Gilster

[57] ABSTRACT

A ski boot fastening device according to the present invention is applied to a ski boot comprising an outer shell and an inner boot fitted in the outer shell. The ski boot fastening device comprises an outer shell, an inner boot fitted in the outer shell, an ankle tight-holding long member for contracting the upper portions of a front cuff and a rear cuff of the outer shell to hold tight the ankle portion of a skier inserted in the inner boot, an ankle clamp lever to which the ankle tight-holding long member is connected, an instep tight-holding long member for pressing and holding tight the instep portion of the skier against the outer shell, an instep clamp lever to which the instep tight-holding long member is connected, and tightening force adjust mechanisms respectively incorporated on the instep clamp lever and the ankle clamp lever to adjust respective tightening forces of the ankle tight-holding long member and the instep tight-holding long member, wherein the instep clamp lever and the ankle clamp lever are both turnably mounted on the rear cuff of the outer shell side by side.

5 Claims, 6 Drawing Sheets

SKI BOOT FASTENING DEVICE

The present invention relates to an improvement in a fastening device for a ski boot comprising an outer shell and an inner boot fitted inside the outer shell.

As to a ski boot comprising an outer shell and an inner boot fitted inside the outer shell, there is hitherto known a fastening device which holds tight a foot of a skier inserted in the inner boot against the outer shell. For example, as disclosed in Japanese Patent Laid-Open No. 60-225502 or No. 61-109502, a front cuff and a rear cuff jointly constituting the outer shell are contracted at their upper portions by a clamp device, which consists of a fastening buckle and a fastening band secured to the upper lateral portion of the front cuff. A fastening cable or fastening band stretched over the outer peripheral surface of the inner boot corresponding to the instep or ankle portions is led to outside the outer shell and then tightened by a clamp lever pivotally connected to the lower end of a flat cut-out portion of the outer shell on its rear surface, the clamp lever being rotatable rearward.

Alternatively, Japanese Patent Laid-Open No. 62-64301 discloses a ski boot fastening device in which a clamp device is vertically disposed on the rear portion of the rear cuff, and includes a clamp lever to which fastening cables for respectively holding tight the instep and ankle portions of the skier are connected.

In the former fastening device, 60-225,502, when the clamp lever is set in its clamped state, the mechanism including the clamp lever is entirely lengthwise in the flat cutout portion of the rear cuff on its rear surface. However, only a part of the depth mechanism is accommodated therein and hence the greater part of the mechanism is substantially exposed to the outside. Therefore, a problem arises in that the fastening device may be released from its fastened state upon interference with a ski plate or any other objects, or that the skier tends to be injured by striking the exposed part when falling. Likewise, in the clamp device for holding tight the ankle portion of the skier, the fastening buckle is exposed laterally from the upper portion of the front cuff, thereby resulting in a drawback that the fastened state may loosen upon interference with a ski plate, etc. Further, since the clamp device for holding tight the ankle portion and the clamp device for holding tight the instep portion are separately attached to the ski boot in vertically spaced relation, an additional drawback arises in that the tightening operation cannot be made quickly.

On the other hand, according to the latter fastening device disclosed in Japanese Patent Laid-Open No. 62-64301, the clamp device for holding tight the ankle portion and the clamp device for holding tight the instep portion are disposed at one place on the rear portion of the rear cuff, so the ankle portion and the instep portion can be tightened by single operation concurrently. Thus arises another problem, that the upper clamp device must be simultaneously released from its clamped state, for adjusting a tightening force of the lower clamp device, while the upper clamp device is also released from its clamped state upon the lower clamp device being released from its clamped state.

The present invention has been accomplished in view of the above-mentioned situations in the art, and has for its objects to provide a ski boot fastening device which can avoid interference of any parts of the fastening mechanism with a ski plate, etc., which can tighten the ankle portion and the instep portion concurrently, and which can adjust respective tightening forces to hold tight the ankle portion and the instep portion independently of each other.

A ski boot fastening device according to the present invention comprises an outer shell, an inner boot fitted in the outer shell, an ankle or tightness maintaining long member, or wire, cable, or the like, for contracting the upper portions of a front cuff and a rear cuff of the outer shell to hold tight the ankle portion of a skier inserted in the inner boot, an ankle clamp lever to which the ankle tight-holding elongated member is connected, or combined with an instep tight-holding elongated member for pressing and holding tight the instep portion of the skier against the outer shell, an instep clamp lever to which the instep tight-holding elongated member is connected, or combined with and tightening force adjust mechanisms respectively incorporated in the instep clamp lever and the ankle clamp lever to adjust respective tightening forces of the ankle tight-holding elongated member and the instep tight-holding elongated member, wherein the instep clamp lever and the ankle clamp lever are both turnably mounted on the rear cuff of the outer shell side by side.

In the present invention, the instep clamp lever and the ankle clamp lever are accommodated in a recess defined in the rear portion of the outer shell side by side such that both the clamp levers are buried in the recess and turnably mounted. The ankle clamp lever is made equal or larger in size than the instep clamp lever.

Further, the ankle clamp lever includes a tongue covering a part of the instep clamp lever, the tongue being abutted against the instep clamp lever when the ankle clamp lever is lowered, allowing the instep clamp lever to be lowered concurrently. Preferably, the tongue covering a part of the instep clamp lever and the instep clamp lever are lockable to each other by locking means.

According to the present invention, by concurrently pivoting the ankle clamp lever and the instep clamp lever out of their clamped states by the middle (second) finger and the first finger, for example, the ankle tight-holding elongated member and the instep tight-holding elongated member respectively connected to the ankle clamp lever and the instep clamp lever are slacked to release the ankle and instep portions from their tightly held states. By setting the ankle clamp lever and the instep clamp lever to be entirely accommodated in the recess, the ankle tight-holding elongated member and the instep tight-holding elongated member are pulled with tensile forces to hold tight the ankle and instep portions of the skier at the same time.

Meanwhile, with the ankle clamp lever and the instep clamp lever being pivoted out of their clamped states to release the tightening forces exerted on the skier's foot, it is possible to adjust the respective tightening forces exerted on the ankle and instep portions by the use of tightening force adjust mechanisms incorporated in the ankle clamp lever and the instep clamp lever, respectively.

Further, since the ankle clamp lever and the instep clamp lever are disposed in the recess side by side independently of each other, the skier can remove either one of the tightening forces of the ankle clamp lever and the instep clamp lever in their clamped states as required, and hence separately adjust the tightening force of the ankle or instep portion by the associated tightening force adjust mechanism.

Moreover, since the ankle clamp lever and the instep clamp lever can partly be overlapped through the tongue provided on the ankle clamp lever, the instep clamp lever can be lowered too by lowering the ankle clamp lever.

In addition, since the tongue provided on the ankle clamp lever and the instep clamp lever are lockable to each other by the locking means, both the clamp levers can be pivoted concurrently around attachment pins by operating either such lever.

EMBODIMENTS

Figure 1:
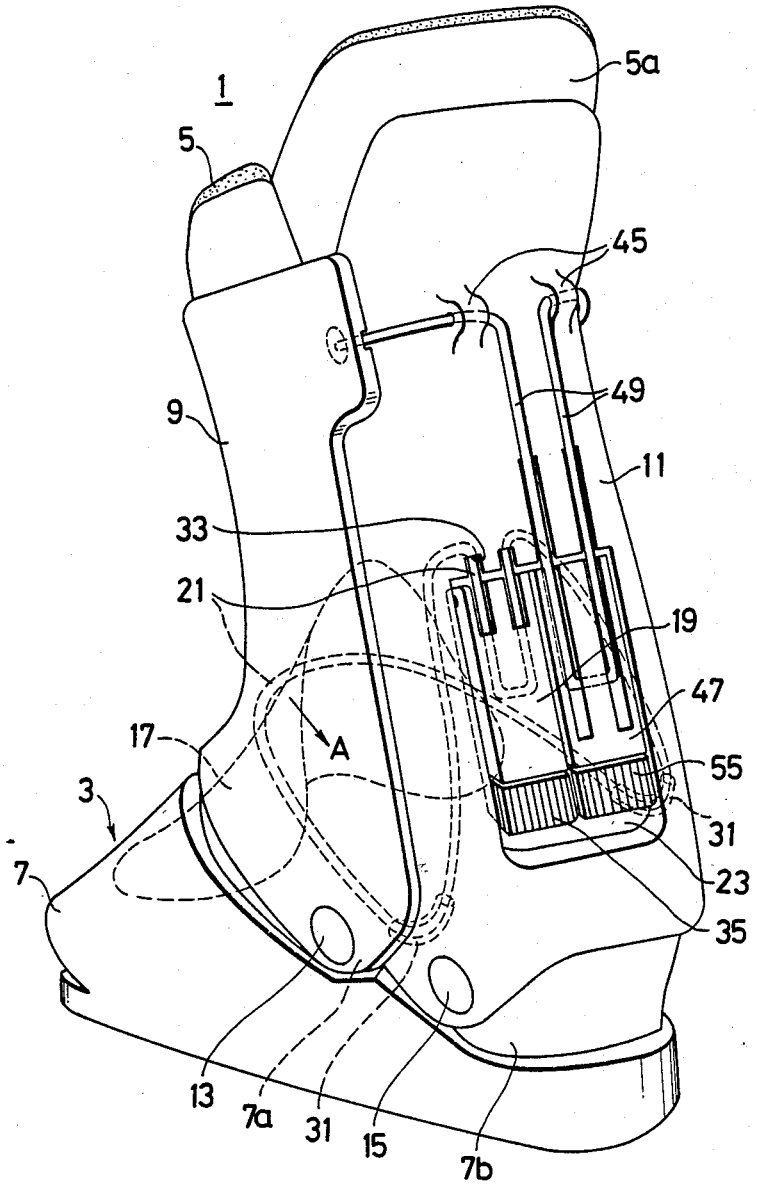
FIG. 1 is a rear perspective view of a ski boot equipped with a fastening device according to a first embodiment of the present invention.

Preferred embodiments of the present invention will be described below in detail with reference to the above drawings.

FIGS. 1 through 4 show a ski boot fastening device according to a first embodiment of the present invention. In these figures, the ski boot generally indicated by reference numeral 1 mainly comprises an outer shell 3 molded from a hard, highly tough synthetic resin material and an inner boot 5 fitted in the outer shell 3.

The outer shell 3 is composed of a shell body 7 mainly covering the portion beneath an ankle, a front cuff 9 covering the area from the front portion of the ankle to a shin, and the rear cuff 11 for covering the area from the upper portion of the heel to the calf. The bifurcated lower ends of the front cuff 9 are pivotally connected to inner and outer anklebone portions 7*a* of the shell body 7 by means of pivot pins 13 so that the front cuff can be tilted forward, while the bifurcated lower ends of the rear cuff 11 are pivotally connected to a heel covering portion 7*b* of the shell body 7 by means of pivot pins 15 so that the rear cuff can be tilted rearward. A rear portion 5*a* of the inner boot 5, overlapping with the rear cuff 11, can be opened and closed together with the rear cuff 11.

Designated at the reference numeral 17 is a presser pad for holding tight the instep portion against the shell body 7. The presser pad 17 is disposed on the outer surface of the inner boot 5 corresponding to the instep portion at a position somewhat nearer to the ankle, with a cable 21 connected to an instep tight-holding clamp lever 19 being stretched over the presser pad 17.

Figure 2:
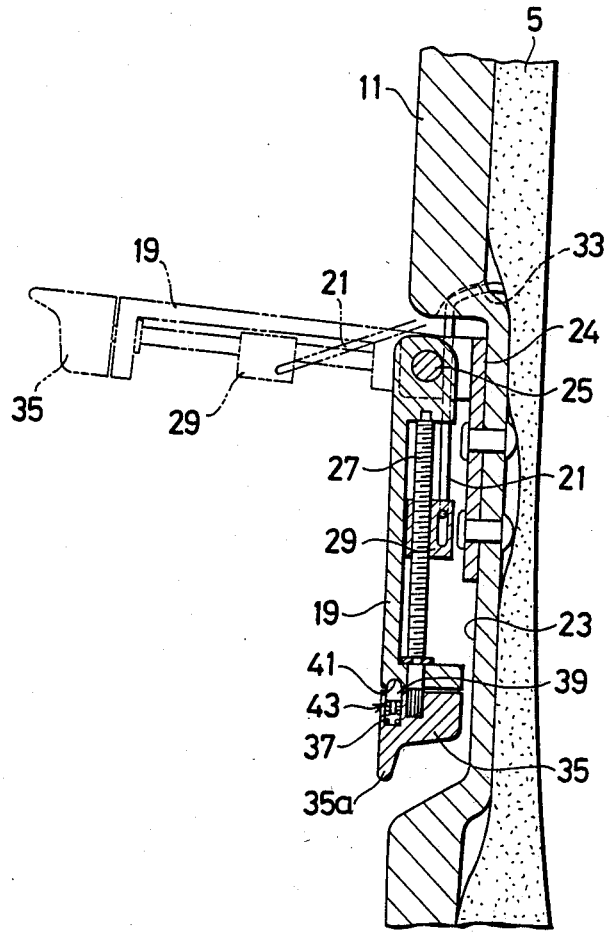
FIGS. 2 and 4 are vertical sectional views of the fastening mechanism of FIG. 1.
Figure 3:
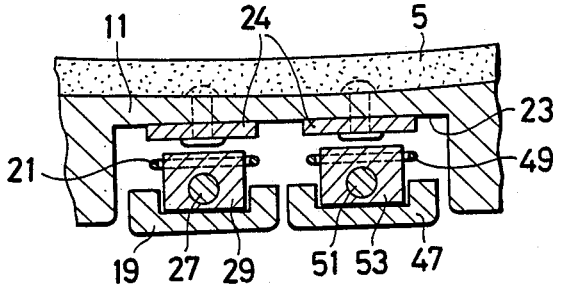
FIG. 3 is a cross-sectional view of the fastening mechanism of FIG. 1.

The instep tight-holding clamp lever 19 is disposed such that it can be accommodated in a vertically elongated recess 23 defined in the rear surface of the rear cuff 11. More specifically, as shown in FIG. 2, the instep tight-holding clamp lever 19 has its upper end pivotally supported in the upper end of the recess 23 by means of a pin 25, which is in turn supported to a pin attachment portion 24 mounted in the recess 23, so that the clamp lever 19 can be turned back and forth. The instep tight-holding clamp lever 19 includes an adjust screw rod 27 extending in the lengthwise direction thereof and having its opposite ends rotatably journalled to the clamp lever 19. A nut member 29 is threaded over the adjust screw rod 27. As best shown in FIG. 3, the nut member 29 is engaged with the instep tight-holding clamp lever 19 to prevent the nut member 29 from rotating about the adjust screw rod 27, whereby the nut member 29 can be slid through the lead of the adjust screw rod 27. The cable 21 stretching over the presser pad 17 is connected to the nut member 29 via guides 31 formed in the inner and outer anklebone portions of the shell body 7 and a through hole 33 bored in the rear cuff 11. The adjust screw rod 27 extends downward from the pivotal end of the instep tight-holding clamp lever 19, and has its lower end to which an adjust know 35 for rotating the adjust screw rod 27 is fixed.

The adjust knob 35 has a rectangular shape in cross section, and is completely accommodated in the recess 23 together with the instep tight-holding clamp lever 19 so as not to project out of the rear cuff 11. A lug 35*a* is provided at the lower end of the adjust know 35 so that when the instep tight-holding clamp lever 19 is upwardly rotated into a state indicated by two-dot chain lines in FIG. 2 for releasing it from its clamped state, the clamp lever 19 can easily be caught by a finger. The adjust knob 35 is provided with a stopper 43 for pressing a lock member or detent ball 39 into a positioning hole 41 defined in the ankle tight-holding clamp lever 19 by the resilient force of a bias spring 37. The stopper 43 serves to normally fix the adjust knob 35 to the instep tight-holding clamp lever 19 (FIG. 2).

Meanwhile, to the upper portion of the front cuff 9 on both lateral sides, there are secured opposite ends of a cable 49 connected to an ankle tight-holding clamp lever 47 through a pair of guide retainers 45 provided on the rear portion of the rear cuff 11. When the cable 49 is tightened, it contracts the upper portions of the front cuff 9 and the rear cuff 11 together, to thereby hold tight the ankle portion of the skier inserted in the inner boot 5. The ankle tight-holding clamp lever 47 is disposed in the recess 23 with the same attachment structure as that of the aforesaid instep tight-holding clamp lever 19, and accommodated in the recess 23 in parallel to the instep tight-holding clamp lever 19.

More specifically, the ankle tight-holding clamp lever 47 has the same shape as the instep tight-holding clamp lever 19 and, as shown in FIG. 2, also has its upper end pivotally supported in the upper end of the recess 23 by means of the pin 25, which pivotally supports the instep tight-holding clamp lever 19 as well, so that the ankle tight-holding clamp lever 47 is disposed in parallel to the instep tight-holding clamp lever 19 in the recess 23 and can be turned back and forth. The ankle tight-holding clamp lever 47 includes an adjust screw rod 51 extending in the lengthwise direction thereof and having its opposite ends rotatably journalled to the clamp lever 47. A nut member 53 is threaded over the adjust screw rod 51. As best shown in FIG. 3, the nut member 53 is engaged with the ankle tight-holding clamp lever 47 to prevent the nut member 53 from rotating about the adjust screw rod 51, whereby the nut member 53 can be slid through the lead of the adjust screw rod 51. The cable 49 fixed to the front cuff 9 is connected to the nut member 53. The adjust screw rod 51 extends downward from the pivotal end of the ankle tight-holding clamp lever 47, and has its lower end to which an adjust knob 55 for rotating the adjust screw rod 51 is fixed.

The adjust knob 55 has the same structure as the aforesaid adjust knob 35. A lug 55*a* is provided at the lower end of the adjust knob 55 and serves to operate the ankle tight-holding clamp lever 47 with ease, similarly to the aforesaid lug 35*a*, when the clamp lever 47 is pivoted into the position indicated by two-dot chain lines for releasing it from its closed state. The adjust knob 55 is provided with a stopper 57 having the same construction as the aforesaid stopper 43.

Figure 4:
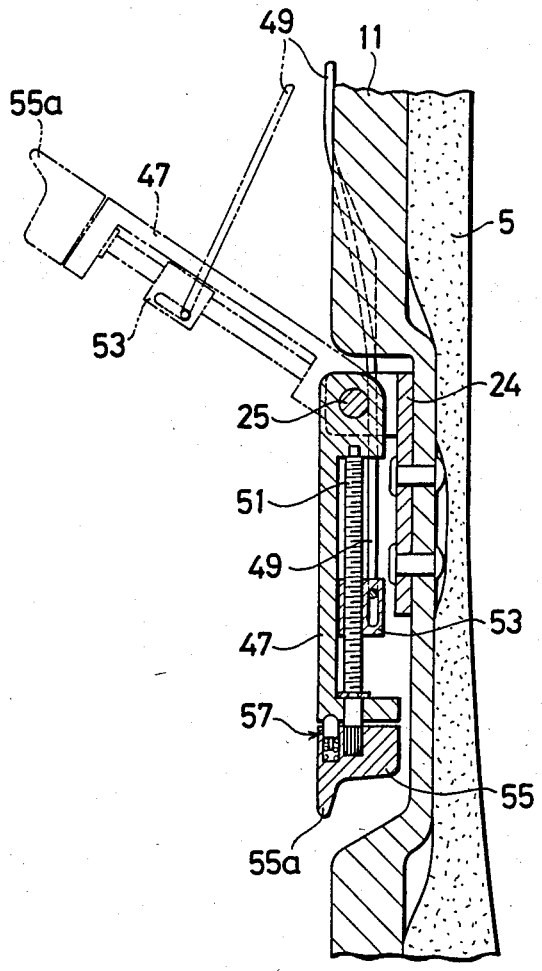

With this embodiment thus constructed, the instep tight-holding clamp lever 19 and the ankle tight-holding clamp lever 47 both set in their clamped states indicated by solid lines in FIGS. 2 and 4 can be released to remove tightening forces exerted on the foot by catching the lugs 35*a*, 55*a* of the adjust knobs 35, 55 with the middle (second) finger and the first finger, for example, and then concurrently rotating both the instep tight-holding clamp lever 19 and the ankle tight-holding clamp lever 47 into their states indicated by two-dot chain lines as shown. Note that the instep tight-holding clamp lever 19 and the ankle tight-holding clamp lever 47 can also be separately operated for rotation to remove the respective tightening forces independently of each other.

Further, when the instep tight-holding clamp lever 19 and the ankle tight-holding clamp lever 47 are set into their state indicated by the solid lines where they are completely accommodated in the recess 23, the cables or elongated members 21, 49 are pulled with tensile forces so that the presser pad 17 is pressed from the upper surface of the inner boot 5 in the direction of an arrow A, causing the instep portion of the skier to be held tight against the shell body 7, and the upper portions of the front cuff 9 and the rear cuff 11 are contracted together to hold tight the ankle portion of the skier. At this time too, the instep tight-holding clamp lever 19 and the ankle tight-holding clamp lever 47 can be operated concurrently to be accommodated into the recess, so operability is significantly improved as compared with the conventional ski boot fastening devices. Furthermore, in this embodiment, the instep tight-holding clamp lever 19 and the ankle tight-holding clamp lever 47 including the adjust knobs 35, 55 are entirely accommodated in the recess 23 with no parts projecting out of the rear cuff 11, thereby allowing the ski boot to be less affected by external forces, avoiding any mutual interference such as hitching with a ski plate or the counterpart of the paired ski boots, and hence preventing the instep tight-holding clamp lever 19 and the ankle tight-holding clamp lever 47 from being unintentionally released due to external impacts or hitching.

On the other hand, when adjusting the respective tightening forces exerted on the ankle and instep portions, the instep tight-holding clamp lever 19 and the ankle tight-holding clamp lever 47 in their clamped states can be pivoted to remove the tightening forces from the foot, and the adjust knobs 35, 55 are rotated to move the nut members 29, 53 lengthwise on the adjust screw rods 27, 51, respectively. In this embodiment, since the instep tight-holding clamp lever 19 and the ankle tight-holding clamp lever 47 are disposed in the recess 23 independently of each other, the skier can remove the tightening force of either the instep tight-holding clamp lever 19 or the ankle tight-holding clamp lever 47 in the clamped states thereof as required, and thereafter adjust the tightening force to be exerted on the ankle or instep portion separately by rotating the associated adjust knob 35 or 55. As a consequence of this, the shortcoming of the fastening device disclosed in the foregoing Japanese Patent Laid-Open No. 62-64301 can be overcome.

Incidentally, while the skier is in the field for skiing, he may selectively release only the ankle portion from its tightly held state at the time of riding on a lift or walking with the ski boots on, for example.

Figure 5:
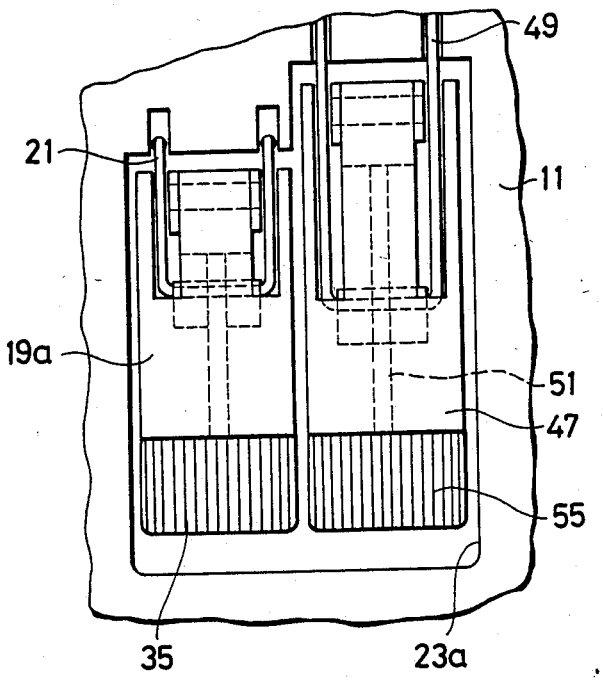
FIG. 5 is a rear view showing a modification of the fastening mechanism of FIG. 1.

Although the instep tight-holding clamp lever 19 and the ankle tight-holding clamp lever 47 having the same shape are disposed in the recess 23 side by side in the above embodiment, it is also possible that, as shown in FIG. 5, an instep tight-holding clamp lever 19*a* to which the cable 21 is connected is made smaller than the other ankle tight-holding clamp lever 47, for example, and the instep tight-holding clamp lever 19*a* and the ankle tight-holding clamp lever 47 are mounted side by side such as to be buried in a recess 23*a* defined in the rear surface of the rear cuff 11 similarly to the above embodiment. The remaining same elements as those in the above embodiment are designated at the same reference numerals and the description of their construction will be omitted here.

With such configuration, to say nothing of the similar operating effect as obtainable with the above embodiment, there is offered advantage that the skier can easily discriminate which of the levers is the instep tight-holding clamp lever and which is the ankle tight-holding clamp lever, when he tries to adjust the tightening force, and hence a mistake can be prevented by avoiding erroneously pivoting the wrong lever.

Further, although the above embodiments have been described as accommodating the respective fastening mechanisms in the recesses 23, 23*a* defined in the rear cuff 11, the present invention is not limited thereto and of course is also applicable to a ski boot in which the fastening mechanism is disposed on the rear surface of the anklebone covering portion 7*b* of the shell body 7*b*. Further, in place of the cables 21, 49, band members may be employed to hold tight the ankle and instep portions. In addition, the inner boot 7 may be pressed by the cable 21 without using the presser pad 17.

Figure 6:
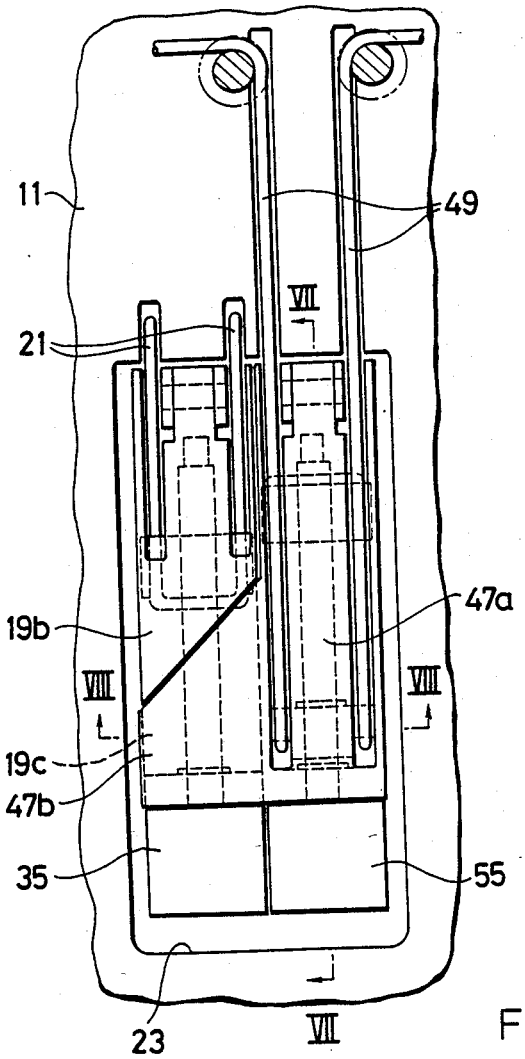
FIG. 6 is an enlarged view of essential parts of a ski boot equipped with a fastening device according to a second embodiment of the present invention.
Figure 7:
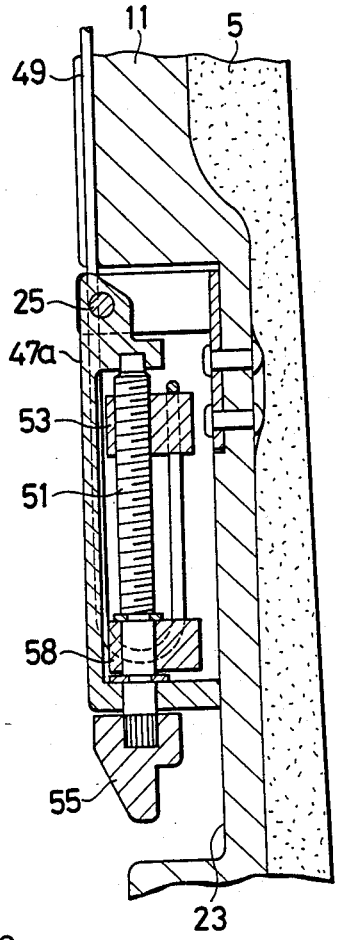
FIG. 7 is a vertical sectional view taken along the line VII—VII in FIG. 6.
Figure 8:
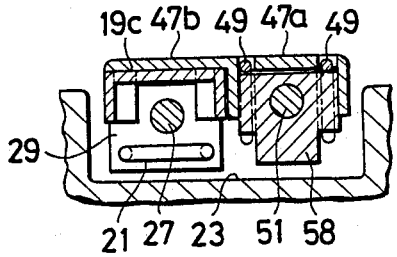
FIG. 8 is a cross-sectional view taken along the line VIII—VIII in FIG. 6.

FIGS. 6 through 8 show still another embodiment of the present invention in which the instep tight-holding clamp lever 19*b* has a trapezoidal stepped portion 19*c* formed in the lower side near to the adjust knob 35, and an ankle tight-holding clamp lever 47*a* has a tongue portion 47*b* formed integrally thereof and extending to lie over the trapezoidal stepped portion 19*c*.

The instep tight-holding clamp lever 19*b* is constructed similarly to the embodiment of FIG. 1 except for the stepped portion 19*c*.

The ankle tight-holding clamp lever 47*a* is different from the embodiment of FIG. 1 in the attachment structure of the wire 49. In this embodiment, a fixing member 58 allowing the wire 49 to pass therethrough is attached to the adjust screw rod 51, and the wire 49 is turned in its extending direction while passing through the fixing member 58 and then fixed to the nut member 53.

According to this embodiment, the instep tight-holding clamp lever 19b and the ankle tight-holding clamp lever 47a can be accommodated in the recess 23 and operated as required in a like manner to the embodiment of FIG. 1.

Since the ankle tight-holding clamp lever 47a has the tongue portion 47b positioned lying over the trapezoidal stepped portion 19c of the instep tight-holding clamp lever 19b, the ankle tight-holding clamp lever 47a can also be lifted concurrently by lifting the instep tight-holding clamp lever 19b as both the clamp levers are lowered in their rest states shown in FIGS. 6 and 7. To the contrary, by lowering the ankle tight-holding clamp lever 47a as the instep tight-holding clamp lever 19b and the ankle tight-holding clamp lever 47a are lifted into their released states, the tongue portion 47b of the ankle tight-holding clamp lever 47a pushes the overlapping trapezoidal stepped portion 19c of the instep tight-holding clamp lever 19b, thereby accommodating both the clamp levers in the recess 23 concurrently so that the ankle and instep portions can be tightened at the same time.

Note that the remaining construction of this embodiment is similar to that of the embodiment of FIG. 1, so the same parts are designated at the same reference numerals and their description will be omitted here.

Figure 9:
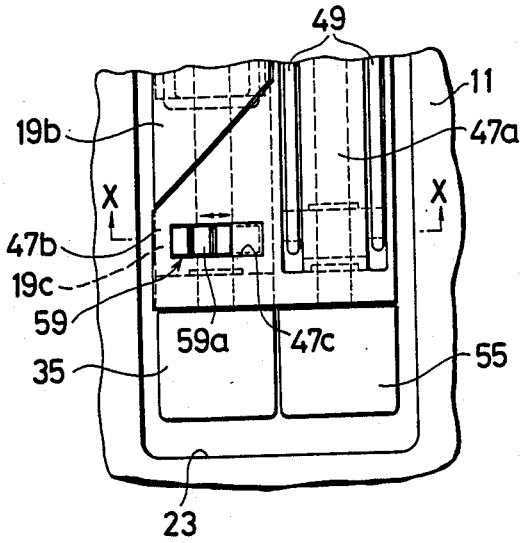
FIG. 9 is an enlarged view of essential parts showing a modification of the ski boot equipped with the fastening device according to the second embodiment of the present invention.
Figure 10:
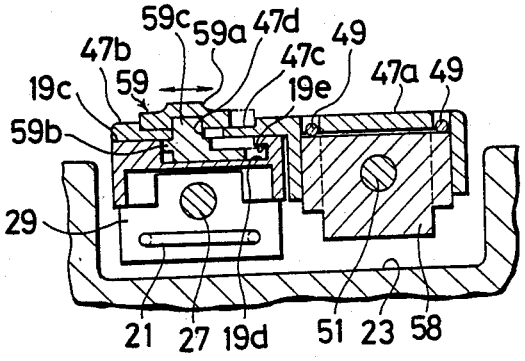
FIG. 10 is a cross-sectional view taken along the line X—X in FIG. 9.

FIGS. 9 and 10 shows a modification of the embodiment shown in FIG. 6. In this modification, engagement means 59 is provided to engage both the clamp levers with each other in the state where the tongue portion 47b of the ankle tight-holding clamp lever 47a is lying over the trapezoidal stepped portion 19c of the instep tight-holding clamp lever 19b.

The engagement means 59 comprises a locking lever 59a and a locking piece 59b. The locking lever 59a is disposed to be movable in a recess 47c defined in the tongue portion 47b, the locking piece 59b is disposed to be movable in a recess 19d defined in the stepped portion 19c. The locking lever 59a and the locking piece 59b are interconnected through a shaft portion 59c of the locking piece 59b. The shaft portion 59c penetrates through a hole 47d bored in the tongue portion 47b.

When the locking lever 59a is positioned away from the ankle tight-holding clamp lever 47a as shown in FIG. 10, the locking piece 59b is apart from an edge slot 19e of the recess 19d, and hence the locking piece 59b is lifted together with only the locking lever 59a by pushing up the ankle tight-holding clamp lever 47a. Therefore, the ankle tight-holding clamp lever 47a is moved, but the instep tight-holding clamp lever 19b remains in rest.

To the contrary, when the locking lever 59a is positioned toward the ankle tight-holding clamp lever 47a as indicated by two-dot chain lines in FIG. 10, the locking piece 59b is fitted in the edge slot 19e of the recess 19d, and hence the locking piece 59b is lifted together with the instep tight-holding clamp lever 19b latched therewith by pushing up the ankle tight-holding clamp lever 47a. Therefore, as the ankle tight-holding clamp lever 47a is moved, the instep tight-holding clamp lever 19b is also moved together.

Thus, with the instep tight-holding clamp lever 19b and the ankle tight-holding clamp lever 47a being interlocked by the locking means 59, both the clamp levers can be released concurrently, allowing the skier to take off the ski boots quickly.

Note that although the foregoing embodiments have been described as accommodating the instep tight-holding clamp lever and the ankle tight-holding clamp lever in the recess defined in the outer shell, they can be attached without providing the recess.

As described above, according to the present invention, it becomes possible to tighten and release both the ankle and instep portions concurrently by simultaneous operation of two clamp levers disposed side by side in parallel, hence to significantly improve operability. Further, since the instep tight-holding clamp lever and the ankle tight-holding clamp lever are entirely accommodated in the outer shell with no parts projecting outward of the outer shell, the ski boot is less affected by external forces, and any mutual interference with a ski plate or other objects can be avoided. Consequently, it also becomes possible to prevent the instep tight-holding clamp lever and the ankle tight-holding clamp lever from being unintentionally released due to external impacts, and from damaging other parts or skiers.

In addition, according to the present invention, the skier can adjust respective tightening forces exerted on the ankle and instep portions independently of each other as required.

What is claimed is:

1. A ski boot fastening device comprising an outer shell having a lower, rearward portion, an inner boot fitted in said outer shell, an ankle tightness maintaining elongated member for contracting the upper portions of a front cuff and a rear cuff of said outer shell to hold tight the ankle portion of a skier inserted in said inner boot, an ankle clamp lever provided in combination with said ankle tightness maintaining elongated member, an instep tightness maintaining elongated member for pressing and holding tight the instep portion of the skier against said outer shell, an instep clamp lever provided in combination with said instep tightness maintaining elongated member, and tightening force adjust mechanisms, being substantially rectangular in cross-section across the non-longitudinal axis thereof, and respectively incorporated in said instep clamp lever and said ankle clamp lever and exposed at the outermost ends thereof to provide such skier with the choice of either independent or simultaneous adjustment of the respective tightening forces of said ankle tightness maintaining elongated member and said instep tightness maintaining elongated member, wherein said instep clamp lever and said ankle clamp lever are both pivotally mounted side by side on said rear cuff of said outer shell.

2. A ski boot fastening device according to claim 1, wherein said instep clamp lever and said ankle clamp lever are accommodated side by side in a recess defined in the rear portion of said outer shell such that both said clamp levers are buried in said recess and pivotally mounted.

3. A ski boot fastening device according to claim 1, wherein said tightening force adjust mechanisms are each provided with detent means for selectably retaining said adjust mechanism in aligned relationship to said clamp levers and for audibly signaling movement into and out of such aligned relationship.

4. A ski boot fastening device according to claim 1, wherein said tightening force adjust mechanisms are provided with a profile to coincide with that of the lower rearward portion of said ski boot outer shell, whereby when closed said tightening force adjust mechanisms conform to and maintain the profile of said ski boot outer shell lower rearward portion.

5. A ski boot fastening device comprising an outer shell having a lower, rearward portion, an inner boot fitted in said outer shell, an ankle tightness maintaining elongated member for contracting the upper portions of a front cuff and a rear cuff of said outer shell to hold tight the ankle portion of a skier inserted in said inner boot, an ankle clamp lever provided in combination with said ankle tightness maintaining elongated member, an instep tightness maintaining elongated member for pressing and holding tight the instep portion of the skier against said outer shell, an instep clamp lever provided in combination with said instep tightness maintaining elongated member, and tightening force adjust mechanisms, being substantially rectangular in cross-section across the non-longitudinal axis thereof, and respectively incorporated in said instep clamp lever and said ankle clamp lever and exposed at the outermost ends thereof to provide such skier with the choice of either independent or simultaneous adjustment of the respective tightening forces of said ankle tightness maintaining elongated member and said instep tightness maintaining elongated member, wherein said instep clamp lever and said ankle clamp lever are both pivotally mounted side by side on said rear cuff of said outer shell; said instep clamp lever and said ankle clamp lever being accommodated side by side in a recess defined in the rear portion of said outer shell such that both said clamp levers are buried in said recess and pivotally mounted; said tightening force adjust mechanisms being each provided with detent means for selectably retaining said adjust mechanisms in aligned relationship to said clamp levers and for audibly signaling movement into and out of such aligned relationship; said tightening force adjust mechanisms further being provided with a profile to coincide with that of the lower rearward portion of said ski boot outer shell, whereby when closed said tightening force adjust mechanisms conform to and maintain the profile of said ski boot outer shell lower rearward portion.

* * * * *